US007270574B1

(12) United States Patent
Ngo

(10) Patent No.: US 7,270,574 B1
(45) Date of Patent: Sep. 18, 2007

(54) COVERS FOR ELECTRICAL CONNECTORS

(75) Inventor: Hung Viet Ngo, Harrisburg, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/348,784

(22) Filed: Feb. 7, 2006

(51) Int. Cl.
*H01R 13/648* (2006.01)

(52) U.S. Cl. ..... 439/608

(58) Field of Classification Search ..... 439/608, 439/609, 610
See application file for complete search history.

(56) References Cited

U.S. PATENT DOCUMENTS

| | | | | |
|---|---|---|---|---|
| 5,055,069 | A | 10/1991 | Townsend et al. | 439/608 |
| 5,453,016 | A | 9/1995 | Clark et al. | 439/79 |
| 5,504,989 | A | 4/1996 | Clark et al. | 29/747 |
| 5,743,765 | A | 4/1998 | Andrews et al. | 439/608 |
| 5,860,816 | A * | 1/1999 | Provencher et al. | 439/79 |
| 5,980,321 | A | 11/1999 | Cohen et al. | 439/608 |
| 6,238,245 | B1 | 5/2001 | Stokoe et al. | 439/608 |
| 6,299,483 | B1 | 10/2001 | Cohen et al. | 439/608 |
| 6,299,484 | B2 | 10/2001 | Van Woensel | 439/608 |
| 6,514,103 | B2 * | 2/2003 | Pape et al. | 439/608 |
| 6,540,522 | B2 | 4/2003 | Sipe | 439/61 |
| 6,641,438 | B1 | 11/2003 | Billman | 439/608 |
| 6,663,401 | B2 | 12/2003 | Billman et al. | 439/76.1 |
| 6,663,429 | B1 | 12/2003 | Korsunsky et al. | 439/608 |
| 6,705,895 | B2 | 3/2004 | Hasircoglu | 439/608 |
| 6,808,419 | B1 | 10/2004 | Korsunsky et al. | 439/607 |
| 6,875,031 | B1 | 4/2005 | Korsunsky et al. | 439/79 |
| 6,884,117 | B2 | 4/2005 | Korsunsky et al. | 439/607 |
| 2001/0005654 | A1 | 6/2001 | Cohen et al. | 439/608 |
| 2006/0281346 | A1 | 12/2006 | Pan | 439/79 |

* cited by examiner

*Primary Examiner*—Phuong Dinh
(74) *Attorney, Agent, or Firm*—Woodcock Washburn LLP

(57) ABSTRACT

A cover for an electrical connector includes substrate mounting beams. When a force is applied to the top, the beams transfer the force to the lead frame, pressing contacts of the connector to an electrical device such as a substrate. Flat rock application may be applied to the top of the cover to connect the connector to a substrate. The cover may aid in retaining the lead frame assemblies in the connector. A cover for an electrical connector may include a back extending from a top such that the back includes resiliency and is able to be flexed while the cover is placed on a connector and flexed to remove the cover from the connector.

15 Claims, 11 Drawing Sheets

COVERS FOR ELECTRICAL CONNECTORS

CROSS-REFERENCE TO RELATED APPLICATIONS

The subject matter disclosed in this patent application is related to the subject matter disclosed and claimed in U.S. patent application Ser. No. 11/087,047, filed Mar. 22, 2005, now U.S. Pat. No. 6,988,902, which is a continuation of U.S. patent application Ser. No. 10/294,966, filed Nov. 14, 2002, now U.S. Pat. No. 6,976,886, which is a continuation-in-part of U.S. patent application Ser. No. 09/990,794, filed Nov. 14, 2001, now U.S. Pat. No. 6,692,272, and of U.S. patent application Ser. No. 10/155,786, filed May 24, 2002, now U.S. Pat. No. 6,652,318. The subject matter disclosed herein is also related to the subject matter disclosed and claimed in U.S. patent application Ser. No. 10/842,397, filed May 10, 2004, now U.S. Pat. No. 7,083,432. The contents of each of the above-referenced U.S. patents and patent applications are herein incorporated by reference in their entireties.

FIELD OF THE INVENTION

The invention relates to electrical connectors. More particularly, the invention relates to covers for electrical connectors.

BACKGROUND OF THE INVENTION

FIG. 1 is a perspective view of an electrical connector 100. The electrical connector 100 may include lead frame assemblies 110 arranged in a housing 105. The lead frame assemblies 100 may include a lead frame housing 108 and contacts 104. The lead frame housing 108 may include a top frame 102 and a terminal frame 111. The top frame may include a lead frame stop 101 that abuts the lead frame housing 105. A retention member 115 may be attached to each of the lead frame assemblies 110 such that it, in combination with the housing 105, the lead frame assemblies 110 are retained in the connector 100. Each lead frame assembly 110 may include an arm 119 that extends over the retention member 115, helping to hold the retention member 115 to the lead frame assemblies 110. The lead frame assemblies 110 may be arranged such that a gap 103 may be formed between each lead frame assembly 110.

The connector 100 may be attached to a substrate such as a printed circuit board. To attach the electrical connector 100 to a substrate, a tool may fit between the gaps 103 and press on the terminal frame component 111 of each lead frame assembly 110. Application of such a tool may be labor intensive and expensive. Moreover, the gap 103 between the lead frame assemblies 110 may allow conductive material or debris to fall and accumulate on the lead frame assemblies 110, contacts 104, and the substrate to which the connector 100 is attached. Such conductive material or debris may damage the connector 100, the substrate, or the interface between the two, or affect the signal integrity at the interface.

SUMMARY OF THE INVENTION

A cover for an electrical connector may include substrate mounting beams extending from a top that abuts a portion of a lead frame assembly of the connector. When a force is applied to the top, the beams transfer the force to the lead frame, aiding in pressing contacts of the connector to an electrical device such as a substrate. In this way, flat rock application may be applied to the top of the cover, obviating use of a tool to fit in between the lead frame assemblies of the connector to connect it to a substrate. The cover additionally may perform retaining functions, aiding in retaining the lead frame assemblies in the connector and preventing a lead frame assembly from movement relative to other lead frame assemblies. Thus, the cover may be seated on the connector, protect the connector from falling debris, provide flat rock application functionality, or aid in retention of lead frame assemblies.

A cover for an electrical connector may include a back extending from the top such that the back is resilient and is able to be flexed while the cover is placed on a connector. When the cover is seated, the back may return to its relaxed state. The back may include a retention bar, helping to prevent the cover from being unseated after being seated. The back additionally may include a release bar, enabling the flexing of the back to unseat the cover from the connector. Such a cover may be seated on the connector either before or after the connector is attached to a substrate or another connector.

DETAILED DESCRIPTION OF ILLUSTRATIVE EMBODIMENTS

Figure 1:
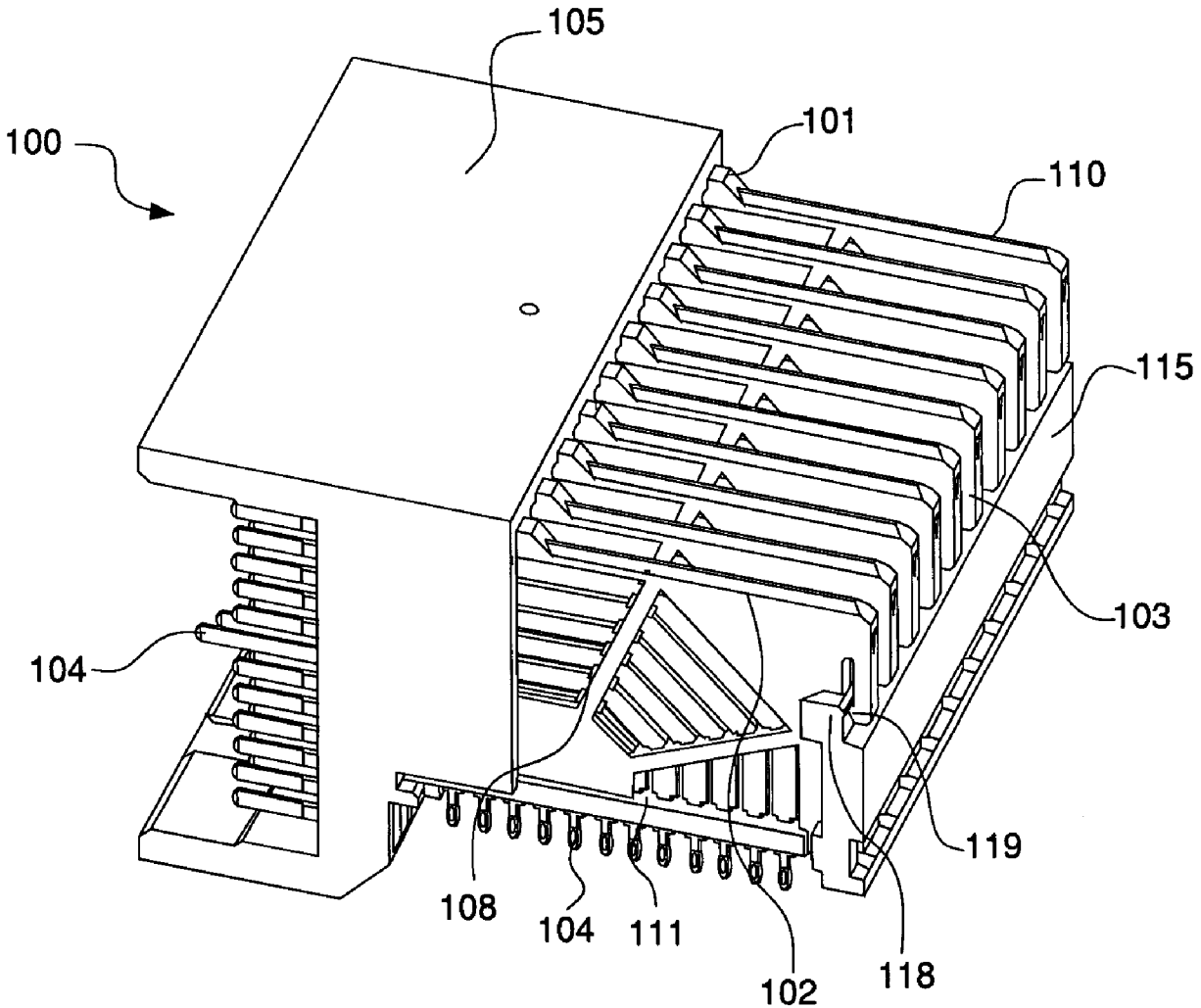
FIG. 1 is a perspective view of an electrical connector.
Figure 2:
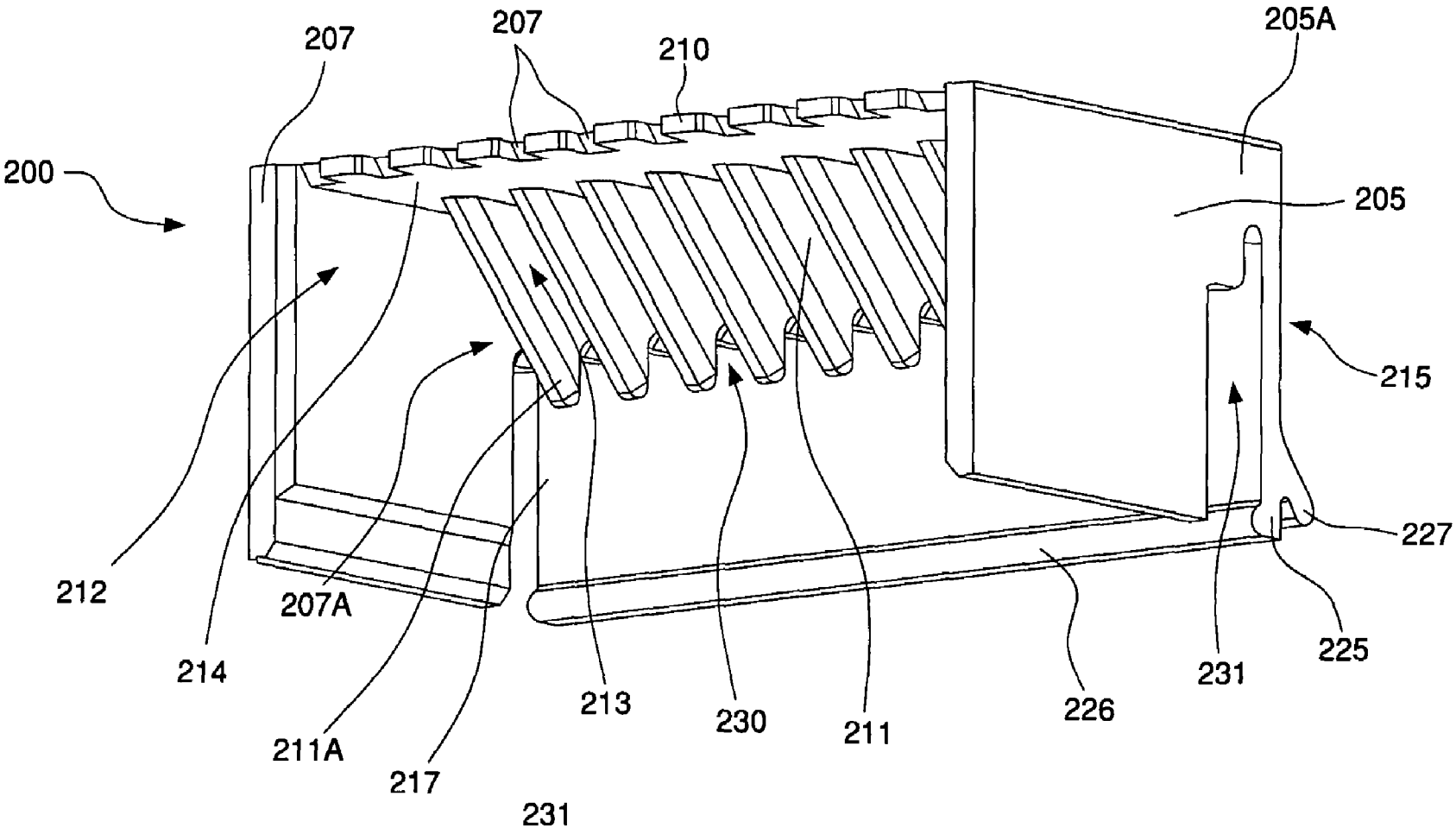
FIG. 2 is a perspective view of a cover for an electrical connector.

FIG. 2 is a perspective view of a cover 200 for an electrical connector (such as connector 100 depicted in FIG. 1, for example). Such a cover 200 may be placed on the connector 100 and aid in protecting the connector 100 from debris falling in between the lead frame assemblies 110. The cover 200 may include opposing side walls 205, 207, a top 210, and a back 215. The back 215 may be a body member of the cover 200 and may include a latch portion 225 for mechanically attaching the cover 200 to the connector 100.

The top 210 and side walls 205, 207 may each be a body member of the cover 300. Each may be generally planar. The top 210 may include lead frame assembly notches 216 for receiving the lead frame stops 101 when the cover 200 is placed on the connector 100. The latch portion 225 may include a release bar 227 and a latch bar 226. The cover 200 additionally may include an interior 212 having lead frame assembly baffles 211. The baffles 211 may be attached to or formed as part of an interior 214 of the top 210. Additionally, the baffles 211 may be spaced apart by a gap 213 that is at least equal to a width of each lead frame assembly 110. In this way, each lead frame assembly 110 may be received in between the baffles 211 when the cover 200 is attached to the connector 100.

The cover 200 may define a retention member aperture 231 in each of the side walls 205, 207. The retention member aperture 231 may be shaped and sized so that each end of the retention member 115 of the connector 100 may extend through the side walls 205, 207 when the cover 200 is placed on the connector 100.

The back 215 of the cover 200 may be attached or formed as part of the top 210. The back 215 also may be attached or formed as part of at least a portion of the side walls 205, 207. The back 215 may be attached to the side walls 205, 207 at respective areas 205A, 207A but may remain separate from the side walls 205, 207 in the vicinity of the retention-member apertures 231. The back 215 may exhibit flexibility characteristics, enabling it to move away from the side walls 205, 207 in the area of the latch bar 226 as the cover 200 is being placed on the connector 100. The back 215 may also have resiliency such that the latch bar 226 and the back 215 move toward the side walls 205, 207 when the cover 200 is seated on the connector 100.

The baffles 211 may be shaped such that a retention member receiving gap 230 is defined between a portion 211A of the baffles 211 and an interior surface 217 of the back 215. The retention member receiving gap 230 may receive the retention member 115 of the electrical connector 100 when the cover 200 is seated on the connector 100. This may best be depicted in FIG. 3.

Figure 3:
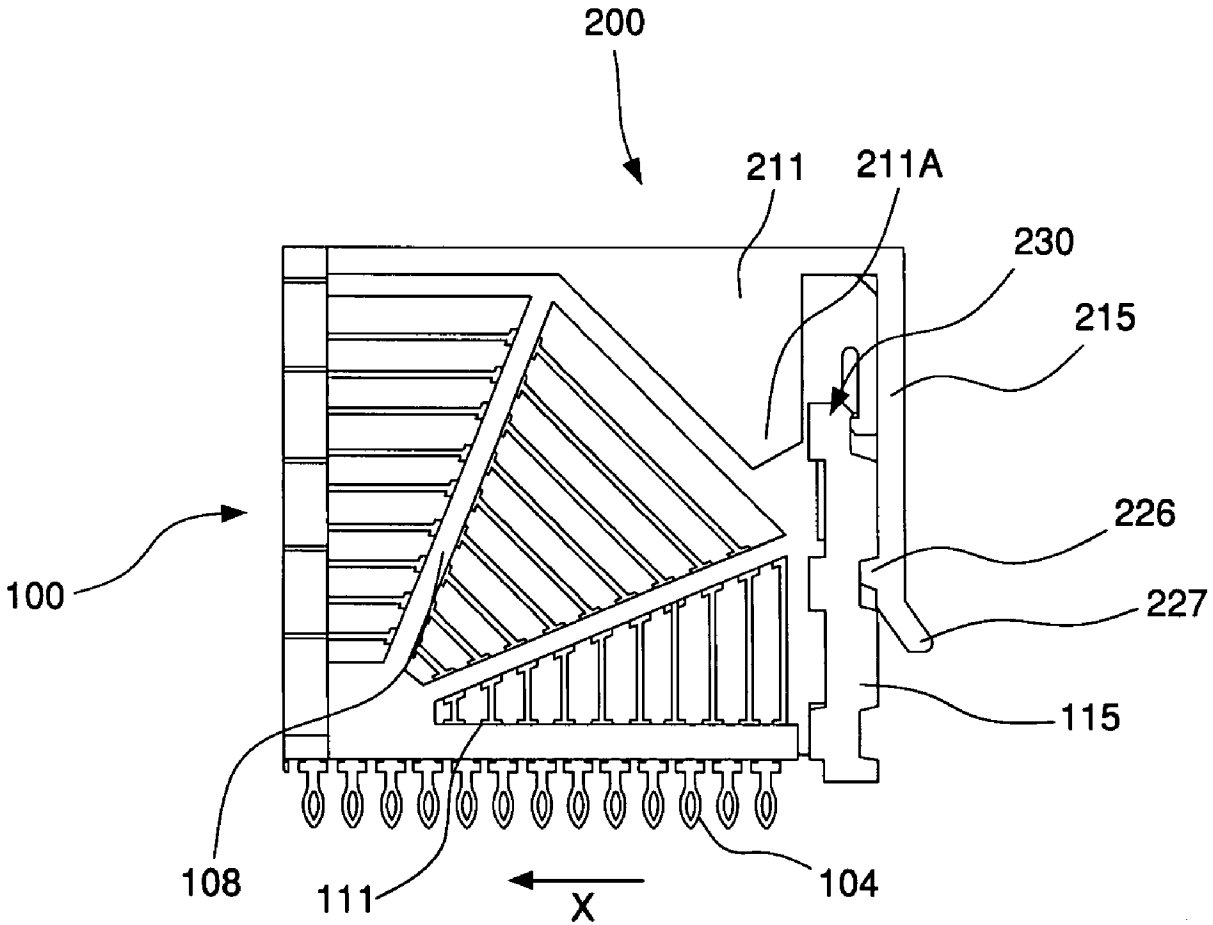
FIG. 3 is a partial cross-sectional side view of a connector with a cover attached.

FIG. 3 is a side cross-sectional view of the connector 100 with the cover 200 seated. The view shows the vicinity of the retention member 115. The retention member 115 may be partially received in the retention member gap 230. In this way, if the cover 200 is moved in a direction indicated by arrow X, the back 215 may abut the retention member 115 and prevent the cover 200 from moving further in the X direction. If the cover 200 is moved in a direction opposite that indicated by the arrow X, then the portion 211A of the baffles 211 may abut the retention member 115 and prevent the cover 200 from moving in that direction.

Figure 4B:
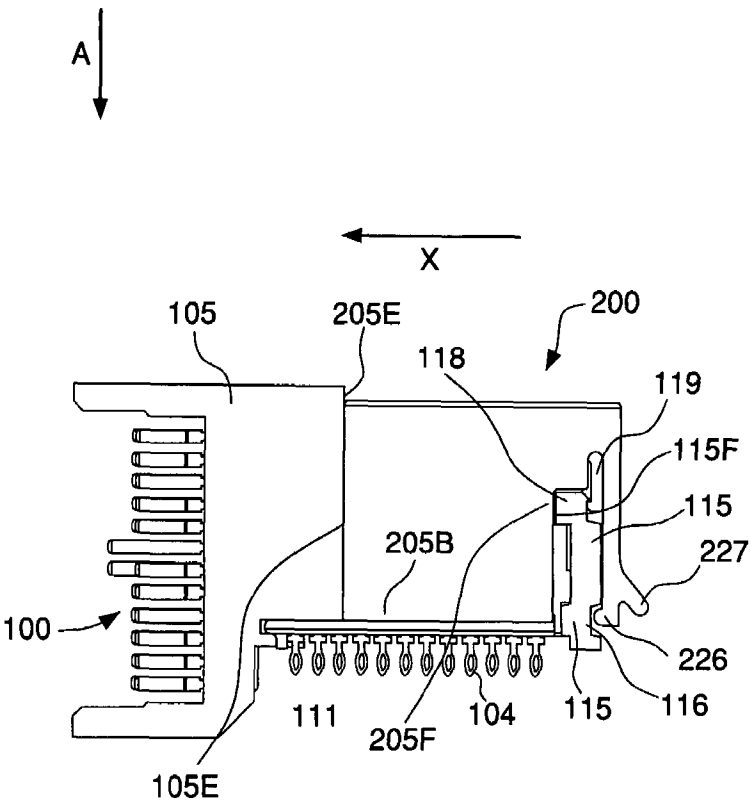
FIG. 4B is a side view of an electrical connector with a cover seated on the connector.
Figure 4A:
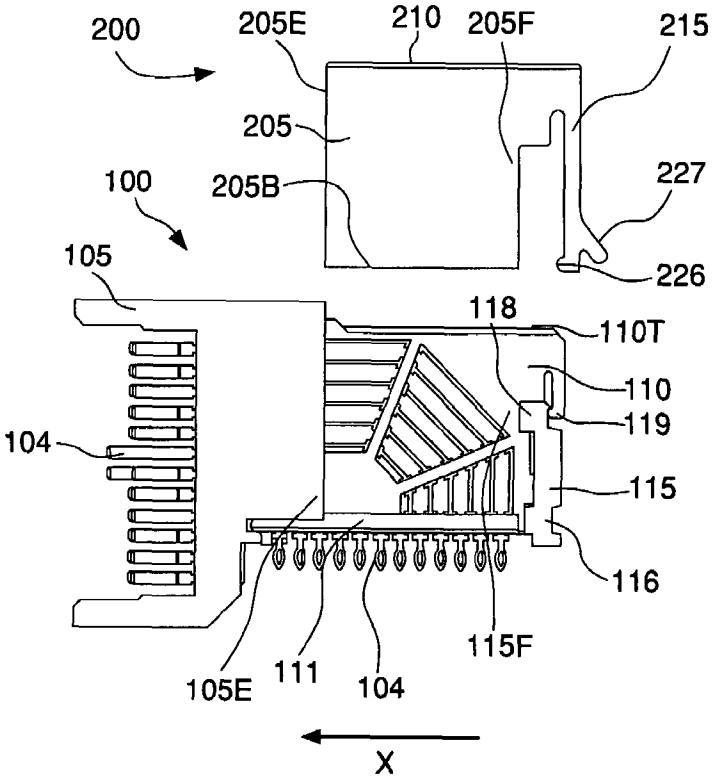
FIG. 4A is a side view of an electrical connector with a cover in position to be seated on the connector.

FIG. 4A is a side view of the electrical connector 100 with the cover 200 in position to be placed on the connector 100. FIG. 4B is a side view of the electrical connector 100 with the cover 200 placed on the connector 100. The cover 200 may be attached to the connector 100 in the direction of the arrow A. An edge 205E of the side wall 205 may abut an edge 105E of the connector housing 105 as the cover 200 is attached to the connector 100, helping to prevent the cover 200 from moving in the direction indicated by arrow X. Additionally, an interior surface of the back 215 may abut the lead frame assemblies 110 of the retention member 115, helping to prevent the cover 200 from moving in the direction indicated by the arrow X as the cover 200 is placed on the connector 100. Another edge 205F of the side wall 205 may abut an edge 115F of the retention member 115, helping to prevent the cover 200 from moving in a direction opposite the direction indicated by arrow X. Alternatively or in addition, as the retention member 115 is received in the retention member receiving gap 230, the portion 211A of the baffles 211 (see FIG. 3) may abut the retention member 115, preventing the cover 200 from moving in the direction opposite the direction indicated by arrow X.

The back 215 of the cover 200 may flex away from the side walls 205, 207 as the latch bar 226 abuts and slides down the lead frame assemblies 110 and the retention member 115 of the connector 100. When the latch bar 226 reaches an indentation 116 in the retention member 115, the back 215 may return to an un-flexed, relaxed condition as the latch bar 226 is received in the indentation 116. The cover 200 may be sized and the latch bar 226 may be a distance from the top 210 of the cover 200 such that, as the latch bar 226 is received in the indentation 116, an interior surface of the top 210 may abut the tops 110T of the lead frame assemblies 110. Thus, the top 210 abutting the lead frame assemblies 110 may help prevent the cover 200 from moving further in the direction indicated by the arrow A. Additionally or alternatively, an edge 205B of the side wall 205 may abut the terminal frame component 111 of the outer most lead frame assemblies 110 and may help prevent the cover 200 from moving further in the direction indicated by the arrow A. The latch bar 226 received in the indentation 116 may help prevent the cover 200 from moving in a direction opposite the direction indicated by arrow A.

The latch bar 226 and the indentation 116 may have corresponding shapes so that, when the latch bar 226 is received in the indentation 116, the cover 200 is seated on the connector 100 and prevented from moving in a direction opposite the direction indicated by the arrow A. The release bar 227 may provide a mechanism for removing the latch bar 226 from the indentation 116. That is, the flexibility provided by retention-member aperture 231 between the side walls 205, 207 and the back 215 may, in combination with the release bar 227, aid in removing the latch bar 226 from the indentation 116, and thus the cover 200 from the connector 100. A force may be applied using a tool or by a hand or finger in the direction generally opposite the direction indicated by the arrow A or in the direction opposite the direction indicated by the arrow X. As the force is applied, the back 215 may flex away from the side walls 205, 207, and the latch bar 226 may be removed from the indentation 116. A force may also be applied in the direction opposite the direction indicated by the arrow A to remove the cover 200 from the connector 100.

The cover 200 may be made of any appropriate material. The cover 200 may be made of a dielectric material such as plastic. The cover 200 additionally may be molded as one piece or alternatively may be assembled from individual pieces. Additionally, the cover 200 may be placed on and removed from the connector 100 either before or after the connector 100 is mounted on a substrate or connected to another electrical connector or device.

Figure 5B:
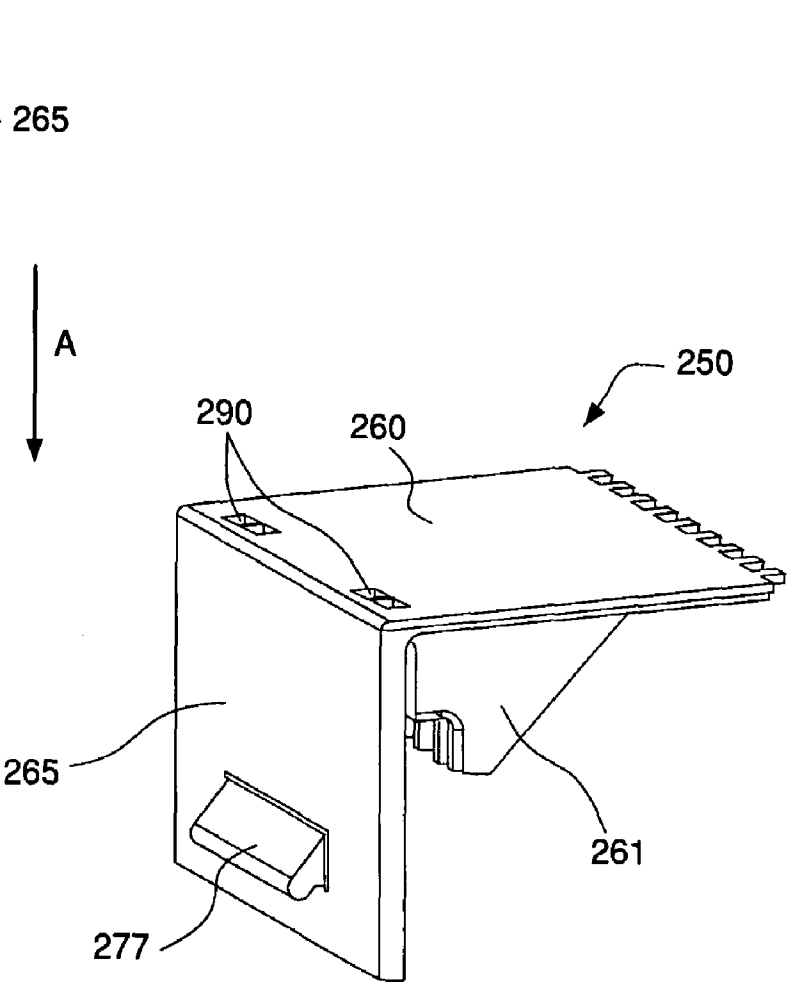
FIGS. 5A and 5B are, respectively, perspective front and back views of an alternate cover for an electrical connector.
Figure 5A:
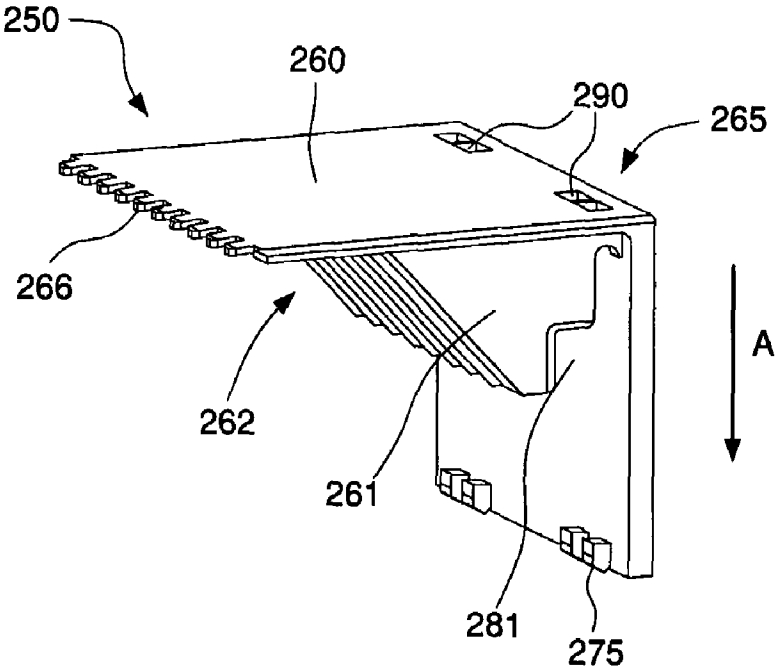

FIGS. 5A and 5B are, respectively, perspective front and back views of an alternate cover 250 for an electrical connector. The cover 250 may include a top 260, and a back 265. The back 265 may be a body member of the cover 200 and may include one or more latch portions 275 for mechanically attaching the cover 250 to the connector 100. Unlike the cover 200, the cover 250 may be devoid of sidewalls, which may increase the flexibility of the back, facilitating latching and unlatching the cover 250 to/from the connector 100.

The top 260 may be a body member of the cover 250. and may include lead frame assembly notches 266 for receiving the lead frame stops 101 when the cover 250 is placed on the connector 100. The top 260 additionally may include apertures 290, or holes, that extend between opposing surfaces of the top 260. The apertures 290 may provide air flow into the interior of the cover 250 and onto the connector 100. The latch portions 275 may include a release bar 277. The cover 250 additionally may include an interior 262 having lead frame assembly baffles 261. Each lead frame assembly 110 may be received in between the baffles 261 when the cover 250 is attached to the connector 100.

The cover 200 may define a retention member aperture 281 between the baffles 261 and the inside of the back wall 265. The retention member aperture 281 may be shaped and sized so that each end of the retention member 115 of the connector 100 may extend between the baffles 261 and the back 265 when the cover 250 is placed on the connector 100.

The back 265 of the cover 250 may be attached or formed as part of the top 260. The back 265 may exhibit flexibility characteristics, enabling it to move away from the baffles 261 in the area of the latch portions 275 as the cover 250 is being placed on the connector 100. The back 265 may also have resiliency such that the latch portions 275 move toward the baffles 261 when the cover 250 is seated on the connector 100.

The back 265 of the cover 250 may flex away from baffles 261 as the latch portions 275 abut and slide down the lead frame assemblies 110 and the retention member 115 of the connector 100. When the latch portions 275 reach an indentation 116 in the retention member 115, the back 265 may return to an un-flexed, relaxed condition as the latch portions 275 are received in the indentation 116. The cover 250 may be sized and the latch portions 275 may be a distance from the top 260 of the cover 250 such that, as the latch portions 275 are received in the indentation 116, an interior surface of the top 260 may abut the tops 110T of the lead frame assemblies 110. Thus, the top 260 abutting the lead frame assemblies 110 may help prevent the cover 250 from moving further in the direction indicated by the arrow A.

The latch portions 275 and the indentation 116 may have corresponding shapes so that, when the latch portions 275 are received in the indentation 116, the cover 250 is seated on the connector 100 and prevented from moving in a direction opposite the direction indicated by the arrow A. The release bar 277 may provide a mechanism for removing the latch portions 275 from the indentation 116. That is, the flexibility provided by retention-member aperture 231 between the baffles 261 and the back 265 may, in combination with the release bar 277, aid in removing the latch portions 275 from the indentation 116, and thus the cover 250 from the connector 100. A force may be applied using a tool or by a hand or finger in the direction generally opposite the direction indicated by the arrow A. As the force is applied, the back 265 may flex away from the baffles 275, and the latch portions 275 may be removed from the indentation 116. A force may also be applied in the direction opposite the direction indicated by the arrow A to remove the cover 250 from the connector 100.

The cover 250 may be made of any appropriate material. The cover 250 may be made of a dielectric material such as plastic. The cover 250 additionally may be molded as one piece or alternatively may be assembled from individual pieces. Additionally, the cover 250 may be placed on and removed from the connector 100 either before or after the connector 100 is mounted on a substrate or connected to another electrical connector or device.

Figure 6:
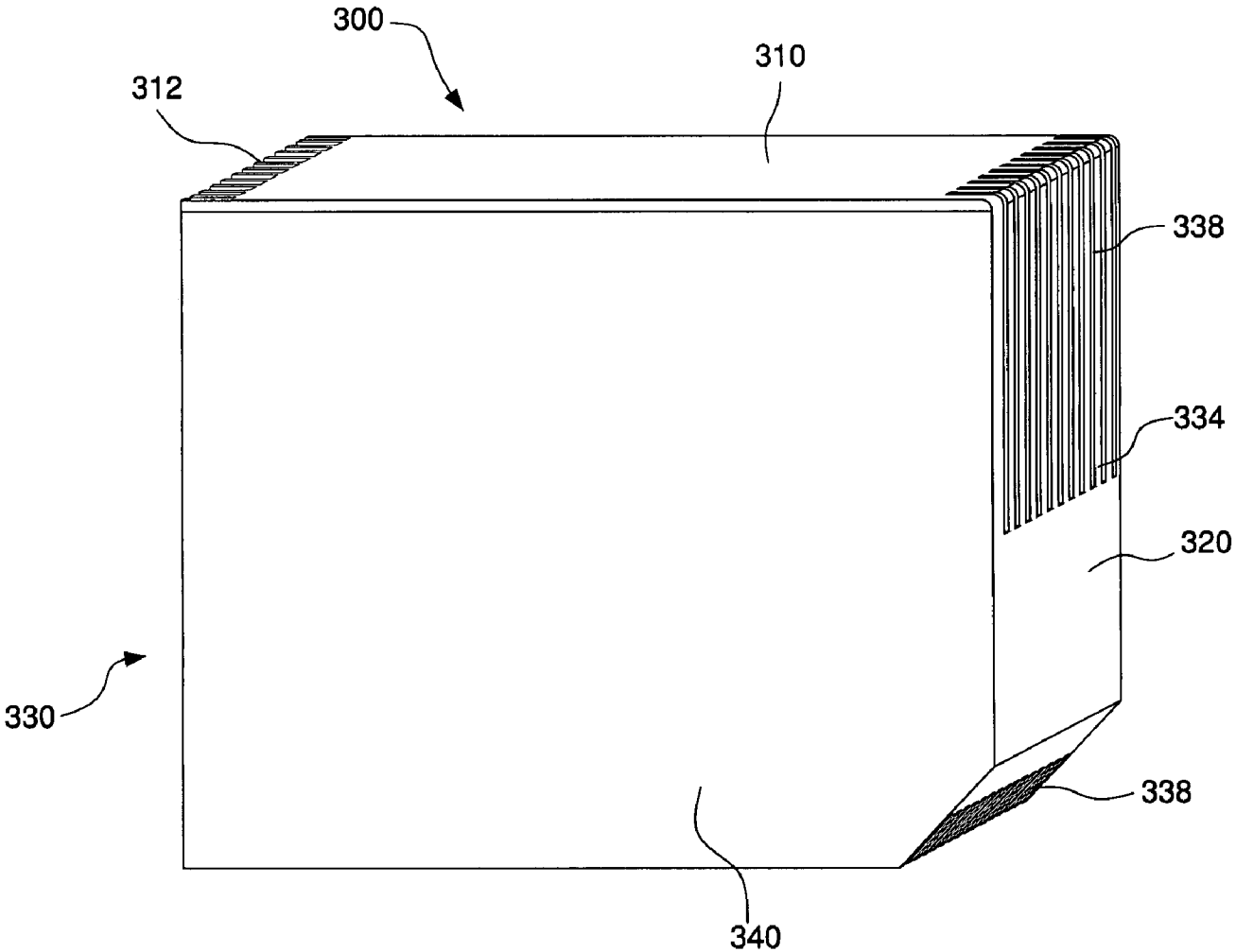
FIG. 6 is a perspective view of an alternative cover for an electrical connector.

FIG. 6 is a perspective view of an alternative cover 300 for an electrical connector such as the electrical connector 100. The cover 300 may aid in preventing, for example, debris from falling in between lead frame assemblies 110 of the electrical connector 100. Additionally, the cover 300 may include interior substrate mounting beams that facilitate mounting the electrical connector to a substrate without use of a tool that extends in between the lead frame assemblies 110 to press on the terminal frames 111 of the lead frame housings 108. Instead, the cover 300 may be placed on the connector 100 prior to mounting on a substrate. The top 310 of the cover 300 may be a body member of the cover 300 and may be generally planar. The top 310 may be pressed upon to connect the connector 100 to the substrate. A flat rock application tool may perform such pressing.

The cover 300 may include a front 330, opposing sides 340, a top 310, and a back 320. The sides 340, top 310, and back 320 may be body members forming the exterior of the cover 300 and may be generally planar. The back 320 may be a body member of the cover 300 and may include lead frame assembly slots 338 for receiving lead frame assemblies 110 of the connector 100. The lead frame assembly slots 338 each may include a retaining surface 334 that, in combination with the lead-frame assemblies 110, helps, among other things, retain the cover 300 on the connector 100. The top 310 may include lead frame stop slots 312 the function of which is described herein.

Figure 7A:
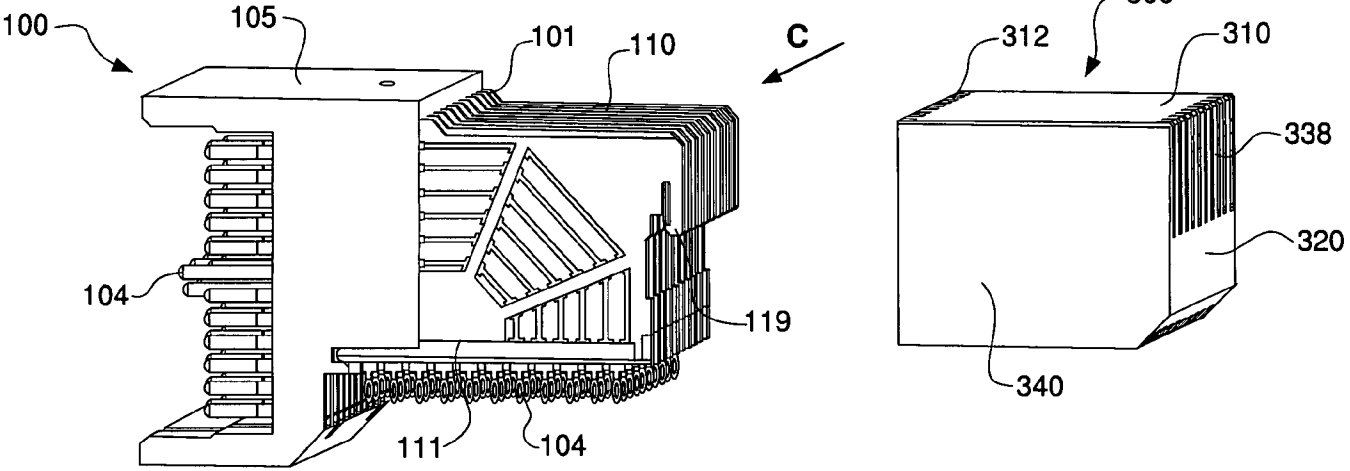
FIG. 7A is a perspective view of the alternative cover positioned to be seated on a connector.
Figure 7B:
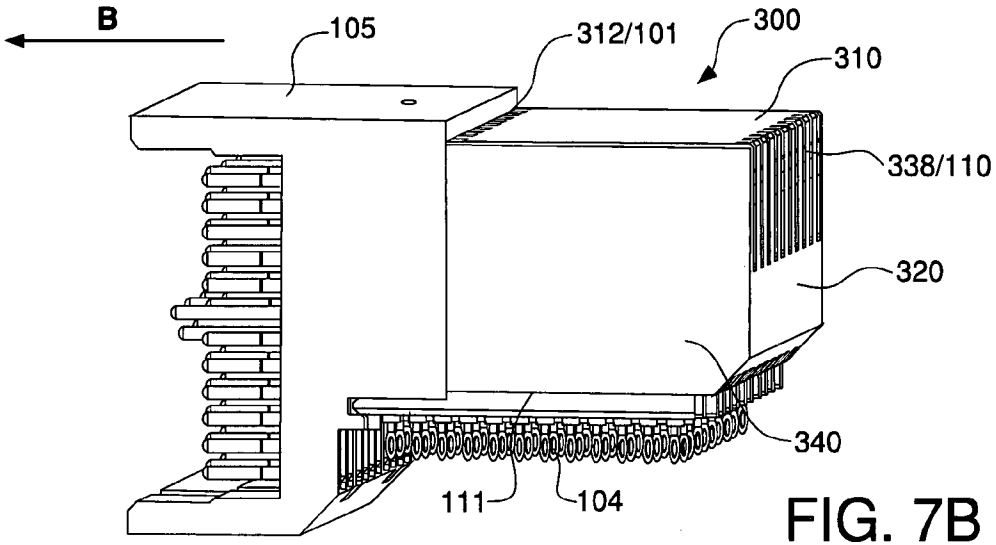
FIG. 7B is a perspective view of the alternative cover seated on the connector.

FIG. 7A is a perspective view of the cover 300 being placed on the connector 100, and FIG. 7B is a perspective view of the cover 300 in place on the connector 100. The cover 300 may slide on the connector 100 in a direction indicated by an arrow B, generally parallel to the mating ends of the contacts 104 and toward the housing 105. Lead frame stop slots 312 may receive respective lead frame stops 101 of the lead frame assemblies 110. As shown in FIG. 7B, when placed on the connector 100, the top 310 of the cover 300 may be flush with the lead frame stops 101 of the lead frame assemblies 110. The cover 300 additionally may abut the housing 105 of the connector 110, which may help prevent further movement of the cover 300 in the direction indicated by the arrow B. The lead frame assembly slots 338 may receive a respective lead frame assembly when the cover 300 is seated on the connector 100. When seated, the cover 300 may abut terminal frames 111 of lead frame housings 108 of respective lead frame assemblies 110.

Figure 8A:
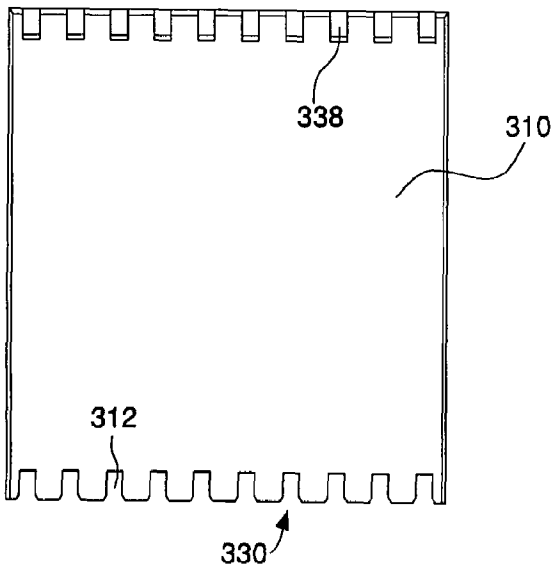
FIGS. 8A-8C depict, respectively, a top view, a front view, and a back view of the alternative cover.
Figure 8B:
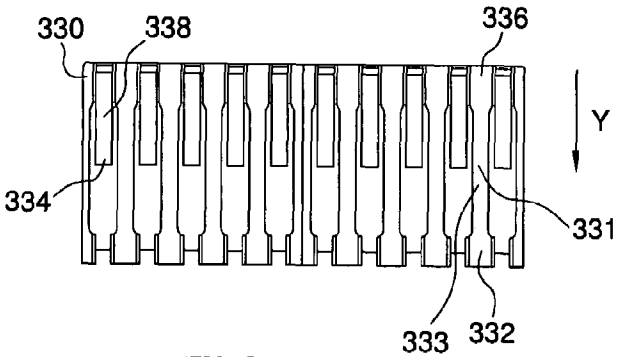
Figure 8C:
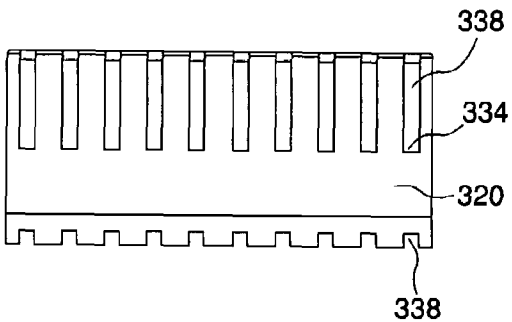

FIGS. 8A-8C depict, respectively, a top view, a front view, and a back view of the cover 300. As shown in FIG. 8A, the top 310 may include the lead frame stop slots 312 toward the front 330 of the cover 300. The top 310 additionally may include lead frame assembly slots 338 for receiving a respective lead frame assembly 110 when the cover 300 is seated on the connector 100.

The front view shown in FIG. 8B shows that the interior of the cover 300 may include substrate mounting beams 331 and lead frame assembly slots 338 formed in between the substrate mounting beams 331. The lead frame assembly slots 338 may receive respective lead frame assemblies 110 when the cover 300 is seated on the connector 100. The substrate mounting beams 331 each may generally include a shape such that, for example, a base 332 and an upper portion 336 of each substrate mount beam 331 are each wider than a middle portion 333 of the substrate mounting beam 331. The substrate mounting beams 331 and respective bases 332 and upper portions 336 may extend along a partial or a whole length of the cover 300.

As shown in FIGS. 8B and 8C, the back 320 of the cover 300 additionally may include a retention member 334 that aids in performing some functions of the retention member 115 of the connector 100. The retention member 334 as well as the lead frame assembly slots 338 may be formed in the back 320 of the cover 300.

Figure 9B:
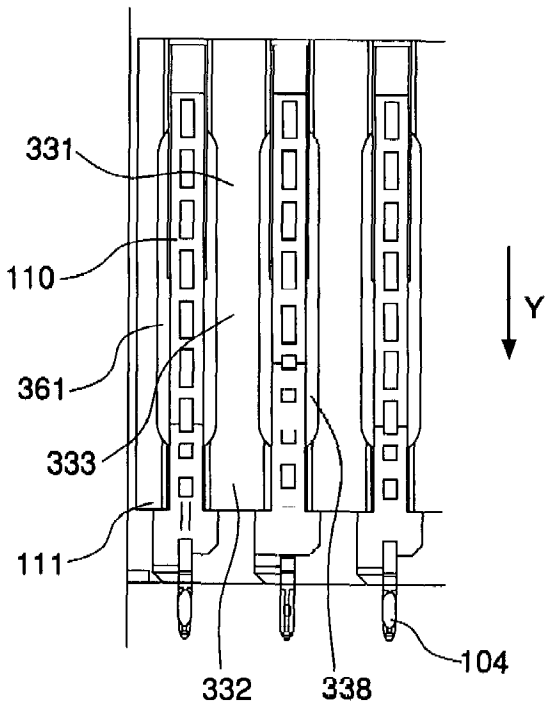
FIGS. 9B and 9C are partial, cut-away views of substrate mounting beams of the alternative cover along with connector lead frame assemblies.
Figure 9A:
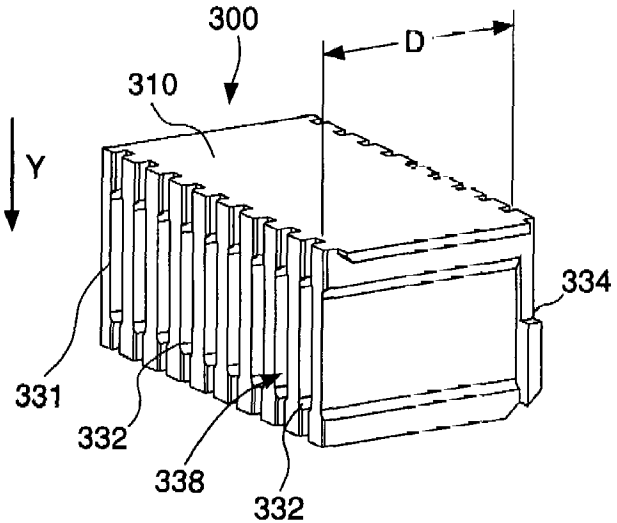
FIG. 9A is a perspective, cut-away view of the alternative cover.
Figure 9C:
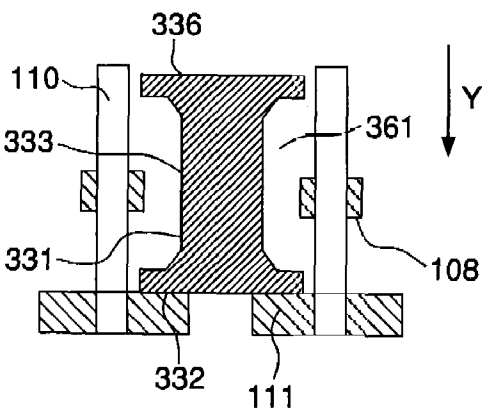

FIG. 9A is a perspective, cut-away view of the cover 300. FIGS. 9B and 9C are partial, cut-away front views of substrate mounting beams 331 and lead frame assemblies 110. When the cover 300 is placed on the connector 100, one or more bases 332 of the substrate mounting beam 331 may abut the terminal frame 111 of the lead frame 108 of the lead frame assembly 110. The bases 332 may be protrusions extending from respective substrate mounting beams 331 and may be molded as part of the substrate mounting beams 331 or may otherwise be attached to the beams 331.

As the cover 300 is slid onto the connector 100, each lead frame assembly 110 may be received in a lead frame assembly slot 338. Each base 332 of a substrate mounting beam 331 may abut a length of a terminal frame 111. After the cover 300 is seated, a force may be applied on the top 310 of the cover 300 generally in a direction indicated by arrow Y. This force may be transferred through the substrate mounting beams 331 and the bases 332 onto the terminal frames 111 of the lead frame assemblies 110. In this way, the cover 300 may aid in attaching or connecting contact terminal ends of the connector 100 to a substrate, such as a printed circuit board. The force in the direction indicated by the arrow Y may be applied in one location on the top 310 of the cover 300, such as, for example, in the approximate middle of the top 310. Alternatively, the force may be applied at multiple locations on the top 310 either simultaneously, in progression along a length of the top 310 (e.g., from the front 330 of the cover 300 to the back 320), or in any other manner. Such force may be applied, for example, by flat rock application.

Because the substrate mounting beams 331 extend between the lead frame assemblies 110, airflow between the lead frame assemblies may be impeded. Thus the middle portion 333 of the substrate mounting beams 331 may be shaped to provide an air gap 361 between the lead frame assembly 110 and the substrate mounting beam 331. Such an air gap 361 may aid in ensuring signal integrity within the connector 100 by, for example, helping to reduce cross talk between contacts 104 of the connector 100.

Figure 10B:
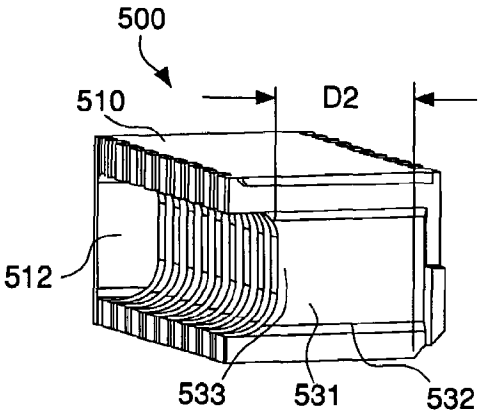
FIGS. 10A-C are perspective views of alternative covers that may aid in improving signal integrity by promoting air flow when the cover is seated on a connector.
Figure 10A:
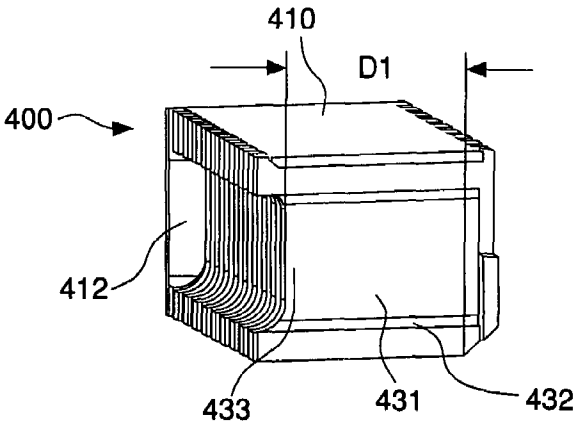
Figure 10C:
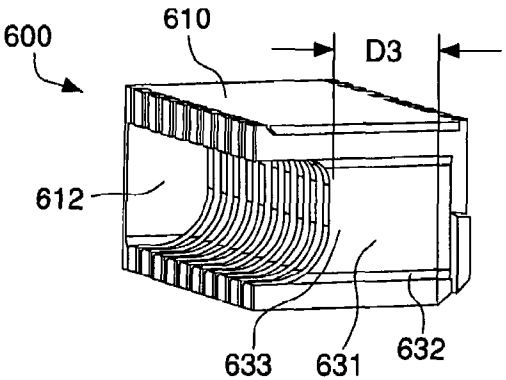

The cover 300 shown in FIG. 9A depicts substrate mounting beams 331 extending along the full length D of the cover 300. In alternative embodiments, the cover may be designed to maximize air flow within the connector 100 when the cover is seated while continuing to provide the flat rock application function. FIGS. 10A-C are perspective views of alternative covers 400, 500, 600, respectively, that may help maximize signal integrity by increasing air flow when the cover is seated on the connector 100.

In FIG. 10A, the cover 400 may include substrate mounting beams 431 shaped such that a gap 412 is formed along a middle portion 433 of respective beams 431. In this way, the middle portion 433 may extend a distance D1 along a length of the cover, and D1 may be less than the length D of the cover 300. The substrate mounting beams 431 may include bases 432 that extend the entire length of the cover 400. In alternative embodiments, the bases 432 may extend less than the entire length.

In FIG. 10B, the cover 500 may include substrate mounting beams 531 shaped such that a gap 512 is formed along a middle portion 533 of respective beams 531. The gap 512 may be larger than the gap 412. The middle portion 533 may extend a distance D2 along a length of the cover, and D2 may be less than the length D1 shown in FIG. 10. The substrate mounting beams 531 may include bases 532 that extend the entire length of the cover 500. In alternative embodiments, the bases 532 may extend less than the entire length.

In FIG. 10C, the cover 600 may include substrate mounting beams 631 shaped such that a gap 612 is formed along a middle portion 633 of respective beams 631. The gap 612 may be larger than the gap 512. The middle portion 633 may extend a distance D3 along a length of the cover, and D3 may be less than the length D2 shown in FIG. 10B.

Any or all of the substrate mounting beams 431, 531, 631 may include respective bases 432, 532, 632 that extend the entire length of the cover 400, 500, 600, as shown in FIGS. 10A-10C, or less than the entire length. Any or all of the substrate mounting beams 431, 531, 631 may include holes or apertures (not shown) extending through the beams to additionally promote air flow.

Figure 11B:
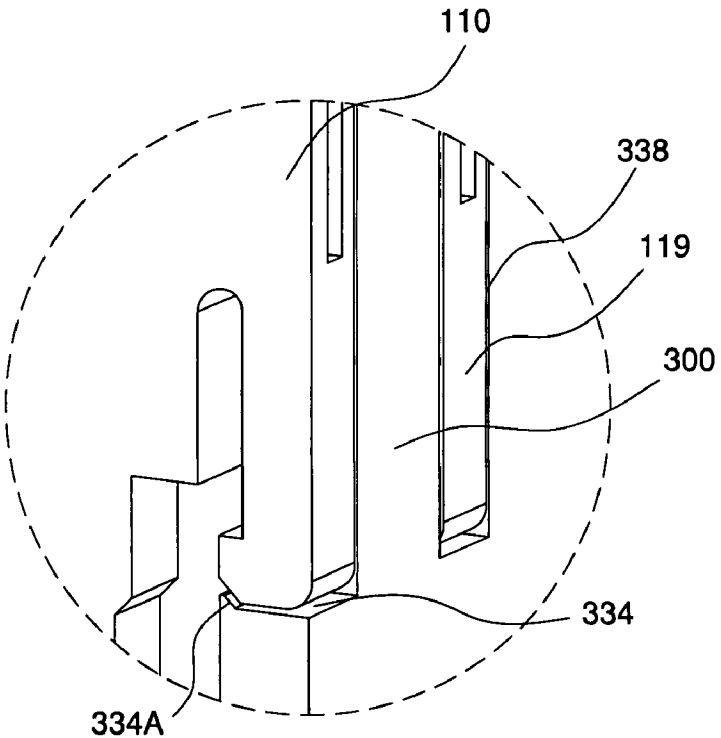
FIGS. 11A and 11B are perspective views of a connector including a cutaway view of the alternative cover seated on the connector.
Figure 11A:
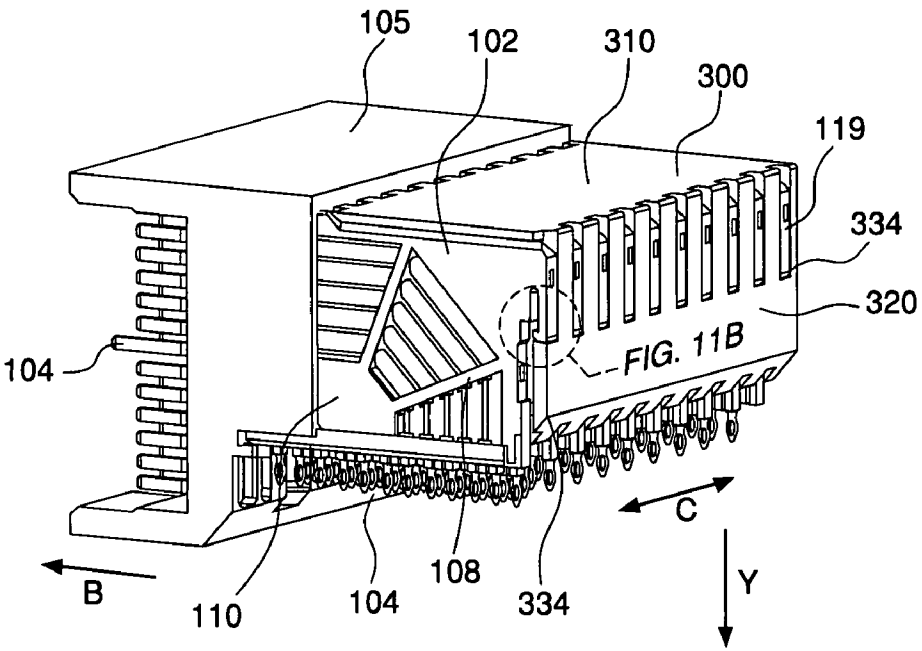

FIG. 11A is a perspective view of a connector 100 including a cutaway view of the cover 300 seated on the connector 100. The arm 119 of the lead frame assembly 110 may abut the retention member 334 of the cover 300. FIG. 11B is a partial, detail view showing the cover 300 seated on the connector 100 and the arm 119 abutting the retention member 334.

As shown in FIG. 11A, the cover 300 may be seated on the connector 100 and the arms 119 of the lead frame assemblies 110 may aid in retaining the cover 300 seated on the connector 100. The lead frame assemblies 110 may be received in the lead frame assembly slots 338 such that the arms 119 abut the lead frame retention member 334. The top 310 of the cover 300 may abut the top frame 102 of the lead frame housing 108 of the lead frame assembly 110. Thus the top frame 102 may aid in preventing the cover 300 from moving in a direction indicated by the arrow Y. Additionally, the arms 119 may aid in preventing the cover from moving in a direction opposite the direction indicated by the arrow Y.

As described herein, the cover 300 may be slid onto the connector 100 in a direction indicated by the arrow B until it abuts the housing 105 of the connector 110. Additionally, the cover 300 may be slid onto the connector 100 until the back 320 of the cover 300 abuts the lead frame assemblies 110. Thus, one or both of the housing 105 and the lead frame assemblies 110 may help prevent the cover 300 from moving in the direction indicated by the arrow B.

The lead frame retention member 334 may be shaped to aid in preventing the cover 300 from moving in a direction opposite the direction indicated by the arrow B. For example, the lead frame retention member 334 may include a lip 334A. The shape of the lip 334A may be complementary to the shape of the arm 119 of the lead frame assembly 110 such that the cover 300 is prevented by the arm 119 from moving in a direction opposite that indicated by the arrow B. As the cover 300 is slid onto the connector 100, there may be "play" enabling the lip 334A to slip under the arm 119 but when fully seated, the lip 334A and the retention member 334 may aid in preventing the cover from being unseated or from moving in a direction opposite the direction indicated by the arrow B.

The cover 300 may perform retention functions as well and thus may obviate use of the retention member 115 (FIG. 1). That is, the retention member 115 on the connector 100 may be removed before placing the cover 300 on the connector 100. Removal of the retention member 115 additionally may contribute to minimizing the weight of the connector 100 while providing a mechanism for attaching the cover 300 to the connector 100. In this way, the cover 300 additionally may perform functions of tying the lead frame assemblies 110 together such that each may be prevented from movement relative to other lead frame assemblies 110. The lead frame assembly receiving slots 338 may receive respective lead frame assemblies 300 and aid in preventing movement of the lead frame assemblies 110 in a direction of and opposite of the direction of the arrow C (i.e., transverse to the direction in which the lead frame assemblies 110 extend). The slots 338 of the cover 300 additionally may aid in preventing one or more lead frame assemblies 110 from rotating when, for example, the connector/cover assembly is connected to an electrical device such as a substrate or another connector, or is otherwise handled.

The cover 300 may be made of virtually any appropriate material. The cover 300 may be made of a dielectric material such as plastic. The cover 300 additionally may be molded as one piece or alternatively may be assembled from individual pieces.

The foregoing illustrative embodiments have been provided merely for the purpose of explanation and are in no way to be construed as limiting of the invention. Words which have been used herein are words of description and illustration, rather than words of limitation. Additionally, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

What is claimed is:

1. A cover for an electrical connector, the electrical connector comprising a lead frame assembly, the cover comprising:

a first body member; and a beam extending from the first body member in a first direction, wherein when the cover is seated on the electrical connector, at least a portion of the beam abuts the lead frame assembly such that a force applied to the first body member in the first direction is transferred to the lead frame assembly.

2. The cover of claim 1, wherein the cover is made of a dielectric material.

3. The cover of claim 1, wherein the at least a portion of the beam is a protrusion extending in a second direction perpendicular to the first direction.

4. The cover of claim 3, wherein the lead frame assembly comprises an electrical contact having an end extending through a frame of a lead frame housing, and wherein the protrusion abuts the frame.

5. The cover of claim 1, wherein the lead frame assembly extends a first distance in a second direction perpendicular to the first direction and the at least a portion of the beam abuts the lead frame assembly for the first distance.

6. The cover of claim 1, wherein the first body member extends a first distance in a second direction perpendicular to the first direction and wherein the beam comprises a middle portion extending a second distance in the second direction that is less than the first distance.

7. The cover of claim 1, further comprising:

a second body member and a third body member opposite the second body member, each extending from the first body member in the first direction, wherein the beam is located between the second and third body members.

8. The cover of claim 1, further comprising:

a fourth body member extending from the first body member in the first direction comprising a lead frame retention member that aids in preventing movement of the cover in a second direction when the cover is placed on the connector.

9. The cover of claim 8, wherein the first body member extends in the second direction.

10. A cover for an electrical connector, the electrical connector comprising a lead frame assembly, the cover comprising:

a top body member extending in a first direction; and a second body member extending from the top body member in a second direction perpendicular to the first direction, the second body member comprising a lead frame retention member that aids in preventing movement of the cover in a third direction when the cover is placed on the connector;

wherein the second body member further comprises a lead frame assembly slot for receiving at least a portion of the lead frame assembly and that aids in preventing movement of the cover in a direction opposite the second direction.

11. The cover of claim 10, wherein the third direction is opposite the first direction.

12. The cover of claim 10, wherein the lead frame retention member abuts at least a portion of a lead frame assembly and aids in preventing movement of the lead frame assembly in the first direction relative to an adjacent lead frame assembly of the connector.

13. The cover of claim 10, wherein the lead frame assembly slot aids in preventing movement of the lead frame assembly in a direction perpendicular to the first direction relative to an adjacent lead frame assembly of the connector.

14. The cover of claim 10, wherein the lead frame assembly slot aids in preventing rotation of the lead frame assembly.

15. The cover of claim 10, wherein the lead frame retention member extends a length in the first direction and comprises a lip, the lip for abutting at least a portion of the lead frame assembly.

* * * * *